US007636081B2

(12) United States Patent
Takamoto et al.

(10) Patent No.: US 7,636,081 B2
(45) Date of Patent: Dec. 22, 2009

(54) ORIGIN RETURNING MECHANISM OF POINTING DEVICE AND POINTING DEVICE USING THE SAME

(75) Inventors: Junji Takamoto, Kyoto (JP); Daisuke Kumazaki, Kyoto (JP); Hirotaka Tomita, Yao (JP)

(73) Assignees: Nintendo Co., Ltd., Osaka (JP); Hosiden Corporation, Osaka (JP)

( * ) Notice: Subject to any disclaimer, the term of this patent is extended or adjusted under 35 U.S.C. 154(b) by 622 days.

(21) Appl. No.: 11/411,245

(22) Filed: Apr. 26, 2006

(65) Prior Publication Data

US 2006/0243080 A1 Nov. 2, 2006

(30) Foreign Application Priority Data

Apr. 28, 2005 (JP) ..... 2005-133519
Aug. 1, 2005 (JP) ..... 2005-222989

(51) Int. Cl.
*G09G 5/08* (2006.01)

(52) U.S. Cl. ..... 345/161; 345/163; 345/156; 273/148 B

(58) Field of Classification Search ..... 345/156, 345/161, 163; 273/148 B; 47/174 XY
See application file for complete search history.

(56) References Cited

U.S. PATENT DOCUMENTS 4,584,510 A * 4/1986 Hollow ..... 318/584
5,459,292 A * 10/1995 Nagano et al. ..... 200/5 R
6,362,810 B1 * 3/2002 Matsuda ..... 345/161

FOREIGN PATENT DOCUMENTS

| | | |
|---|---|---|
| JP | 11-161420 | 6/1999 |
| JP | 2000-276294 | 10/2000 |
| JP | 2001-255995 | 9/2001 |

OTHER PUBLICATIONS

Notification of Reasons for Refusal dated Apr. 21, 2009 for JP 2005-222989.

* cited by examiner

*Primary Examiner*—Amare Mengistu
*Assistant Examiner*—Joseph G Rodriguez
(74) *Attorney, Agent, or Firm*—Nixon & Vanderhye PC

(57) ABSTRACT

A pointing device includes an operating body 200 in which one end operably protrudes from an opening 111*a* of a cover portion 111 of a case body 100 and which is movable depending on the operation toward a horizontal direction from an origin position α; a first returning assisting plate 510 provided with the operating body 200 and having a reception hole 511 penetrating in the thickness direction; a first biasing means 530 which retains the operating body 200 at the origin position α by biasing an outer circumference surface of the first returning assisting plate 510; a fitting block 540 accommodated movably in and out of the reception hole 511; and a second biasing means 550 which biases the fitting block 540 toward the cover portion 111. The fitting block 540 protrudes from the reception hole 511 to fit into the opening 111*a* of the cover portion 111 by being biased with the second biasing means 550 when the operating body 200 is located at the origin position α.

9 Claims, 11 Drawing Sheets

(a)

(b)

600

(a)

(b)

ORIGIN RETURNING MECHANISM OF POINTING DEVICE AND POINTING DEVICE USING THE SAME

CROSS REFERENCE TO RELATED APPLICATIONS

This application is based upon and claims the benefit of priority under 35 U.S.C. §119 of the prior Japanese Patent Application No. 2005-133519 filed on Apr. 28, 2005 and the prior Japanese Patent Application No. 2005-222989 filed on Aug. 1, 2005, and the entire contents of which are incorporated herein by reference.

TECHNICAL FIELD

The exemplary embodiments disclosed herein relate to an origin returning mechanism of a pointing device and a pointing device using the same, which returns a movement-operated operating body to an origin position.

BACKGROUND AND SUMMARY

As this kind of a pointing device, there is provided one which includes an operating body in which one end operably protrudes from an opening of a cover portion of a case body and which is movable depending on the above-mentioned operation toward a horizontal direction from an origin position that is a central position of the opening; first and second moving bodies having first and second elongated holes extending in the Y and X directions, into which the other end of the operating body is inserted and which are movable in the X and Y directions depending on movement of the operating body; first and second signal output units which output first and second signals depending on movement of the first and second moving bodies; and an origin returning mechanism for returning the operating body to the origin position.

The origin returning mechanism is configured to include first and second coil springs which are accommodated along the X and Y directions in first and second accommodation portions provided at one end in a length direction of the first and second moving bodies; and a pair of protruding-like first and second restraining portions arranged at spaces along the X and Y directions at positions capable of coming into contact with both ends of the first and second coil springs of the case body (refer to Japanese Unexamined Patent Application Publication No. 2001-255995).

In other words, when the operating body is movement-operated and the first and second moving bodies are moved in the X and Y directions, the first and second coil springs are compressed between one wall surface in the length direction of the first and second accommodation portions and the other of the first and second restraining portions. After that, when the operating body is released, the first and second moving bodies are returned to move in the Y and X directions by biasing force of the first and second coil springs, thereby returning the operating body to the origin position.

In this regard, however, the origin returning mechanism uses two coil springs and therefore there is a problem in that the operating body cannot be returned highly precisely to the origin position due to variation in spring force of these coil springs. More particularly, when the origin returning mechanism is used for a long time, there is a possibility of increasing the variation in the spring force of the coil spring, and therefore the problem becomes remarkable.

Furthermore, even where the operating body is positioned at the origin position, there is a case that the first and second moving bodies further move in the Y and X directions due to inertia force of returning movement. Such movement which exceeds the origin position causes false operation in the case where sensitive operation is required. Also in this regard, the operating body cannot be highly precisely returned to the origin position.

The exemplary embodiments disclosed herein have been devised in view of the above-described problems, and it is a feature of certain exemplary embodiments to provide an origin returning mechanism of a pointing device and a pointing device using the same, which can perform highly precise returning operation of an operating body.

To solve the above problems, according to certain exemplary embodiments, there is provided an origin returning mechanism of a pointing device having an operating body in which one end operably protrudes from an opening of a cover portion of a case body and which is movable depending on the operation toward a horizontal direction from an origin position that is a central position of the opening, the origin returning mechanism including: a first biasing means for retaining the operating body at the origin position by biasing an outer circumference surface of the first returning assisting plate; a fitting block accommodated movably in and out of the reception hole of the first returning assisting plate; and a second biasing means for biasing the fitting block toward the cover portion of the case body. The fitting block protrudes from the reception hole of the first returning assisting plate to fit into the opening of the case body by being biased with the second biasing means when the operating body is located at the origin position.

It is a feature of certain exemplary embodiments that a surface of the fitting block facing the cover portion and/or a surface of an opening edge of the cover portion of the case body facing the fitting block are/is tapered.

In the case where the opening of the cover portion of the case body is substantially round, the first returning assisting plate is a substantially round-shaped plate-like body; and the first biasing means is a coil spring in which one end in a longitudinal direction is shrunk in diameter as compared with the other end, the one end coming into contact with the outer circumference surface of the first returning assisting plate.

The operating body may be provided with a plate-like portion under the arrangement position of the first returning assisting plate. In this case, the second biasing means is a coil spring in which one end in a longitudinal direction is shrunk in diameter as compared with the other end and is arranged between the fitting block and the plate-like portion in a compressed state.

It is a feature of certain exemplary embodiments that the second returning assisting plate formed in a ring shape is provided at an upper portion of the outer circumference surface of the first returning assisting plate. In this case, one end of the first biasing means comes into contact with a lower portion of the outer circumference surface of the first returning assisting plate and a lower surface of the second returning assisting plate.

According to certain exemplary embodiments, there is provided a pointing device including: an operating body in which one end operably protrudes from an opening of a cover portion of a case body and which is movable depending on the operation toward a horizontal direction from an origin position that is a central position of the opening; first and second moving bodies movable depending on the movement of the operating body in X and Y directions in the case body; and first and second signal output units which output a signal depending on the movement of the first and second moving bodies. The pointing device includes the origin returning mechanism as described above which returns the operating body to the origin position.

The case body includes an upper case having the cover portion, a lower case mounted on the upper case, and a pedestal arranged between the upper and lower cases. On a surface of the pedestal facing the cover portion of the upper case, there is provided a substantially sphere-like convex portion in which a center is located on the plumb line of the origin position and which is convexly curved toward the cover portion. In this case, the surface of the plate-like portion facing the convex portion is a sphere-like concave surface and the plate-like portion is slidable on the convex portion with the movement of the operating body.

In a space between the pedestal and the lower case, a built-in board disposed on a bottom plate of the lower case and first and second moving bodies movable in X and Y directions along on the surface of the built-in board are accommodated. The pedestal is provided with a hole portion in which a center is located on the plumb line of the origin position and the first and second moving bodies are provided with first and second elongated holes extending in the Y and X directions. The other end of the operating body passes through the hole portion of the pedestal to be inserted into the elongated holes provided in the first and second moving bodies.

The first and second signal output units includes: first and second resistance circuits provided on the surface of the built-in board; and first and second contacts attached at longitudinal ends of the first and second moving bodies and slidably connectable to the first and second resistance circuits.

The origin returning mechanism of the pointing device according to certain exemplary embodiments is such that the outer circumference surface of the first returning assisting plate is biased by the first biasing means to retain the operating body at the origin position. That is, it is such that the operating body is returned to the origin position by only the biasing force of the first biasing means and therefore returning operation of the operating body can be highly accurately performed, not suffering from spring force variation caused by a plurality of coil springs as in the conventional example. Furthermore, the fitting block is biased by the second biasing means when the operating body is located at the origin position and therefore the operating body protrudes from the reception hole to fit into the opening of the case body, whereby the operating body can be stopped at the origin position. Therefore, the operating body undergoing the biasing force of the first biasing means will not move beyond the origin position by inertia force of the returning movement. Consequently, in this regard also, the returning operation of the operating body can be highly accurately performed.

Furthermore, in the case where a surface of the fitting block facing the cover portion and/or a surface of an opening edge of the cover portion of the case body facing the fitting block are/is tapered, large force is not required in a starting operation of the operating body for releasing the fitting between the fitting block and the opening of the cover portion of the case body. Consequently, operability of the operating body is increased. Furthermore, in the returning movement, when the fitting block is biased toward the cover portion with the second biasing means in a state where the surface of the fitting block facing the cover portion is sliding on the surface of the opening edge of the cover portion of the case body facing the fitting block; the aforementioned fitting block moves toward the origin position together with the operating body. That is, the biasing force of the second biasing means also contributes as the returning force of the operating body when the operating body is located in the vicinity of the origin position. Therefore, the returning force due to the biasing force of the first biasing means which becomes small in the vicinity of the origin position can be strengthened again and therefore the operating body can be rapidly returned to the origin position.

If the first biasing means is a coil spring in which one end in a longitudinal direction is shrunk in diameter as compared with the other end, this one end of the biasing means comes into contact with the outer circumference surface of the first returning assisting plate which is a substantially round plate-like body so as to bias the first returning assisting plate. Therefore, it becomes possible to uniformize the returning force of the operating body and therefore the returning operation of the operating body can be highly accurately performed.

Furthermore, if the second biasing means is a coil spring in which one end in a longitudinal direction is shrunk in diameter as compared with the other end and if the second biasing means is arranged in a compressed state between a plate-like portion provided under the arrangement position of the first returning assisting plate of the operating body and the fitting block, the second biasing means becomes movable with movement of the operating body and therefore the second biasing means is distorted due to the movement of the operating body and it becomes possible to prevent from generating ununiformization of the biasing force with respect to the fitting block.

In the case where one end of the first biasing means comes into contact with a lower portion of the outer circumference surface of the first returning assisting plate and a lower surface of the ring-shaped second returning assisting plate provided on the upper portion of the outer circumference surface of the first returning assisting plate, the second returning assisting plate enables transmission of the biasing force of the first biasing means to the operating body without missing the biasing force. Consequently, there is a merit that the returning operation of the operating body can be highly accurately performed.

The pointing device according to certain exemplary embodiments can exhibit the same effects as in the above-mentioned origin returning mechanism of the pointing device.

Furthermore, in the case where a pedestal of the case body is provided with a substantially sphere-like convex portion in which a center is located on the plumb line of the origin position and which is convexly curved toward the cover portion of the upper case, a surface of the plate-like portion provided on the operating body facing the convex portion is a sphere-like concave surface, and the concave surface is slidable on the convex portion with the movement of the operating body; sliding operation can be performed in the horizontal direction while the operating body is maintained at a predetermined leaning angle. Consequently, operability of the operating body is improved.

If a space between the pedestal and the lower case accommodates a built-in board disposed on the bottom plate of the lower case, first and second moving bodies movable in X and Y directions along on the surface of the built-in board, and the first and second signal output units outputting a signal depending on the movement of the first and second moving bodies are accommodated; the origin returning mechanism of the pointing device may be accommodated in a separate space from the space for the first and second moving bodies and signal output units of the pointing device, whereby preventing the two mechanisms from interfering with each other.

BRIEF DESCRIPTION OF THE DRAWINGS

FIG. 5A is a schematic front view, and FIG. 5B is a schematic plan view;

FIG. 9A is a schematic plan view, and FIG. 9B is a schematic bottom view;

FIG. 10A is a schematic plan view, FIG. 10B is a schematic front view, and FIG. 10C is a schematic bottom view; FIG. 11A is a schematic plan view, FIG. 11B is a schematic front view, and FIG. 11C is a schematic bottom view.

DETAILED DESCRIPTION

Figure 1:
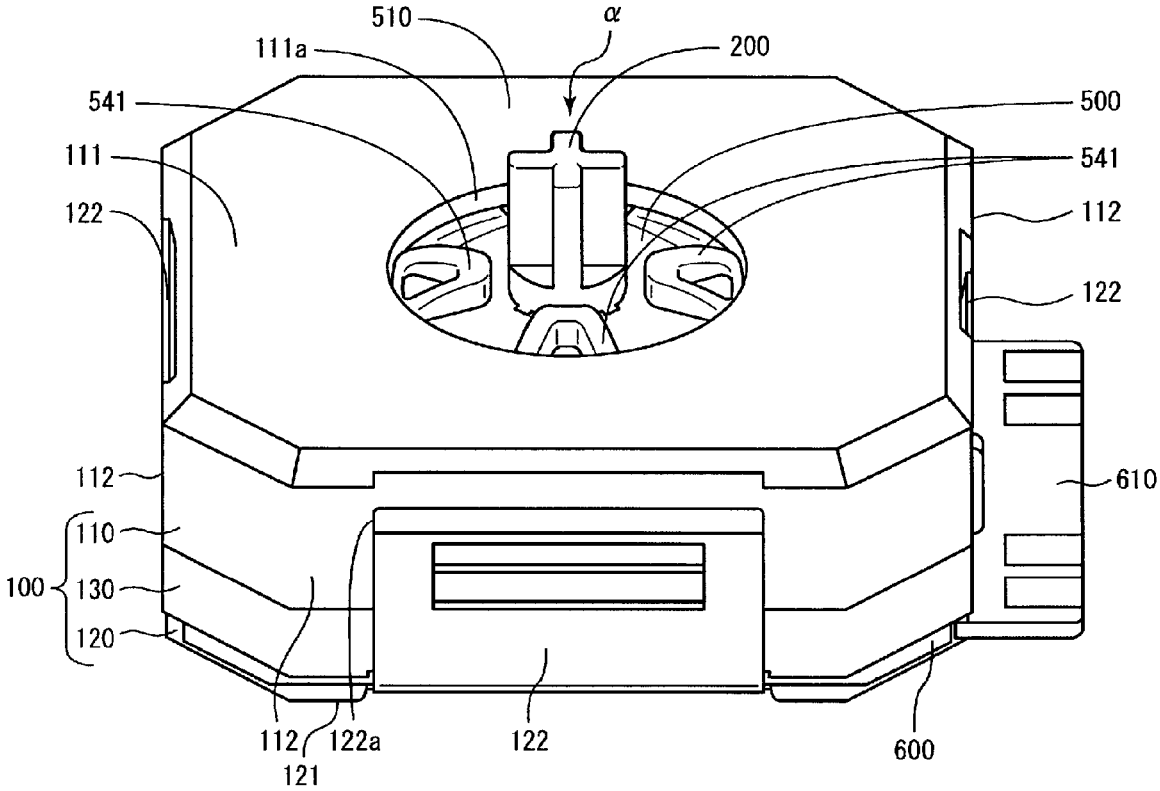
FIG. 1 is a schematic perspective view of a pointing device according to certain exemplary embodiments.
Figure 2:
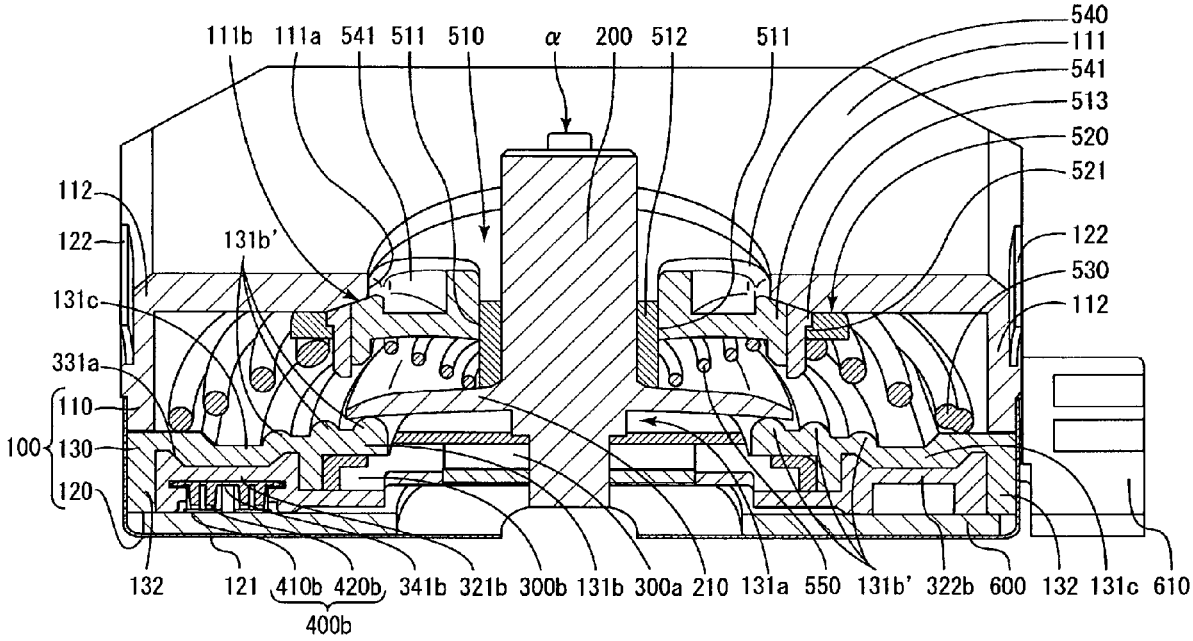
FIG. 2 is a schematic sectional view of the same device.
Figure 3:
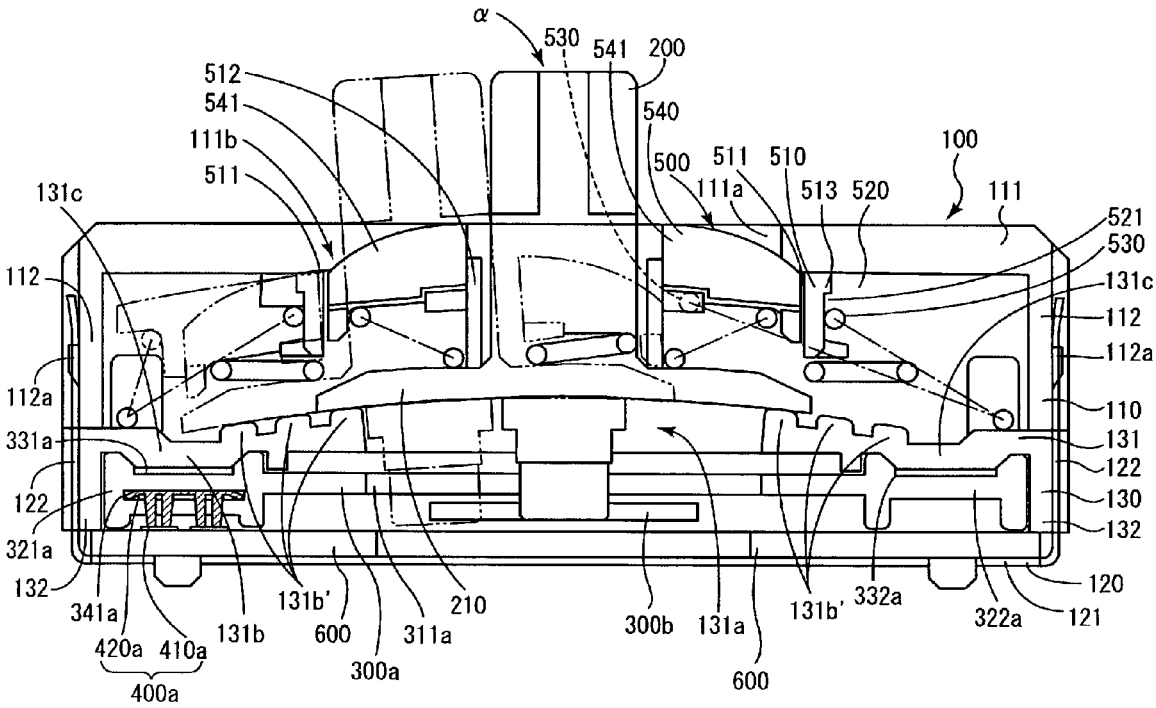
FIG. 3 is a schematic sectional view showing an operation state of the same device.
Figure 4:
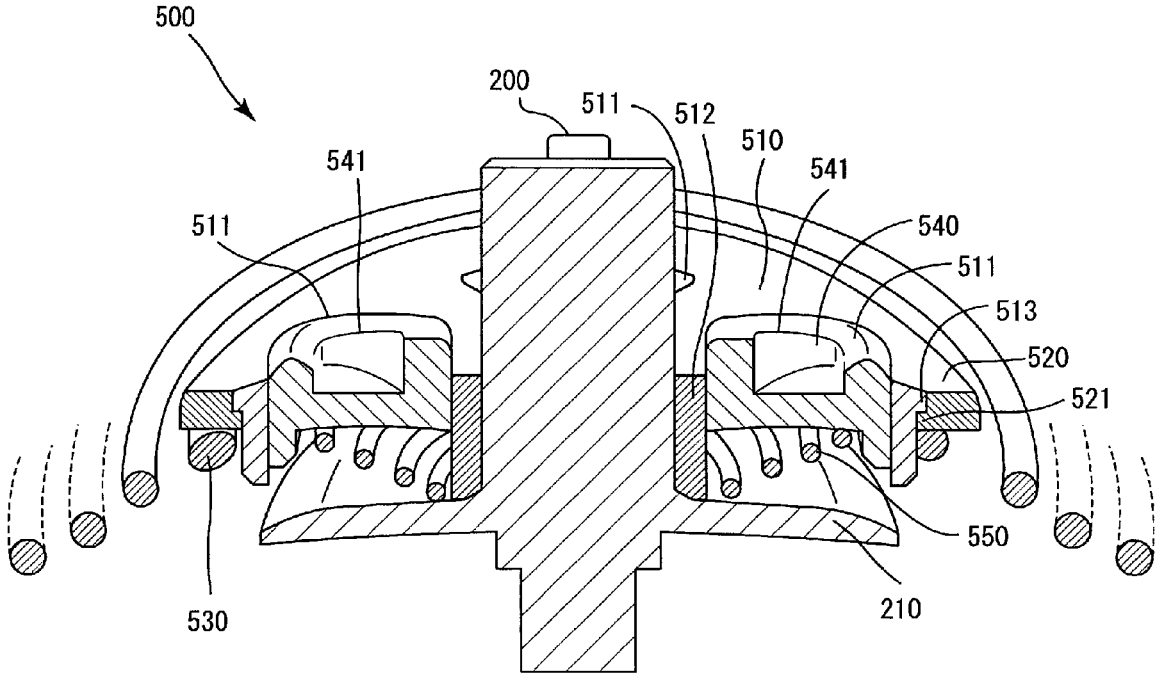
FIG. 4 is a schematic sectional view of an origin returning mechanism of the same device.
Figure 6:
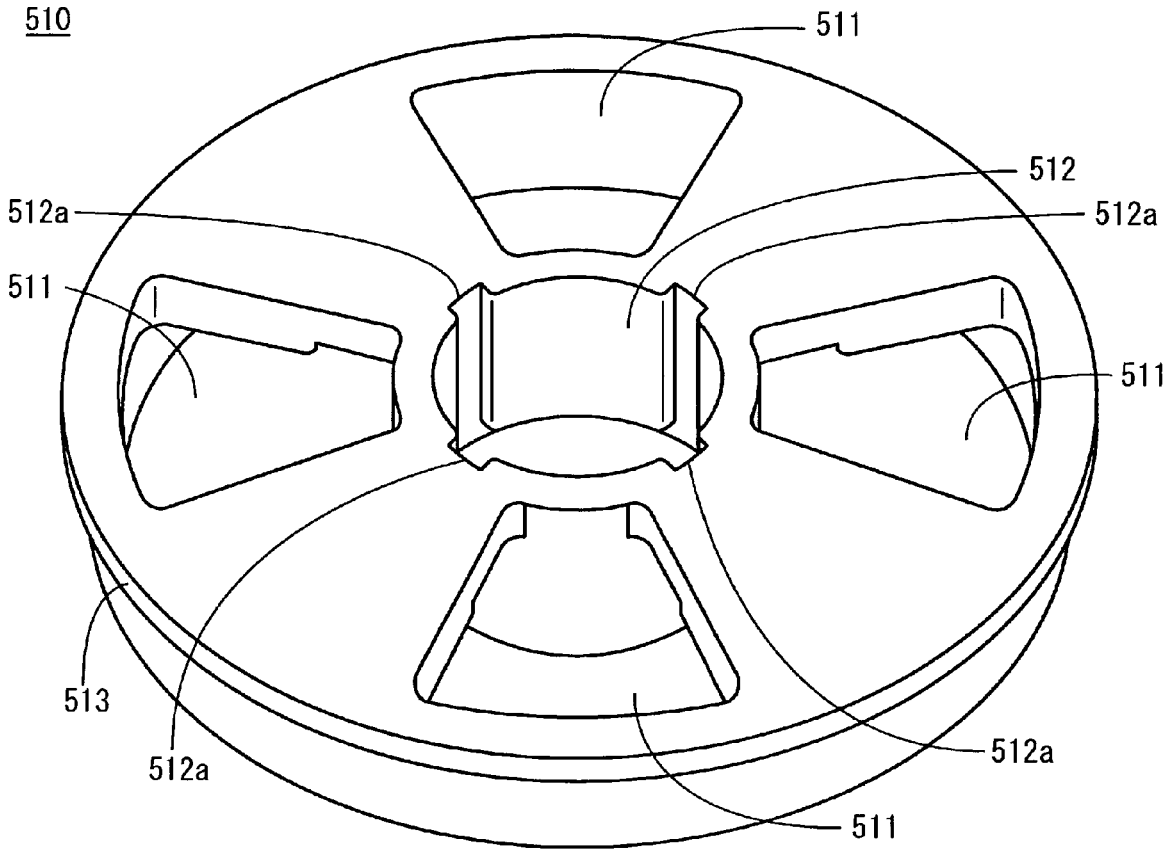
FIG. 6 is a schematic perspective view of a first returning assisting plate of the same device.
Figure 7:
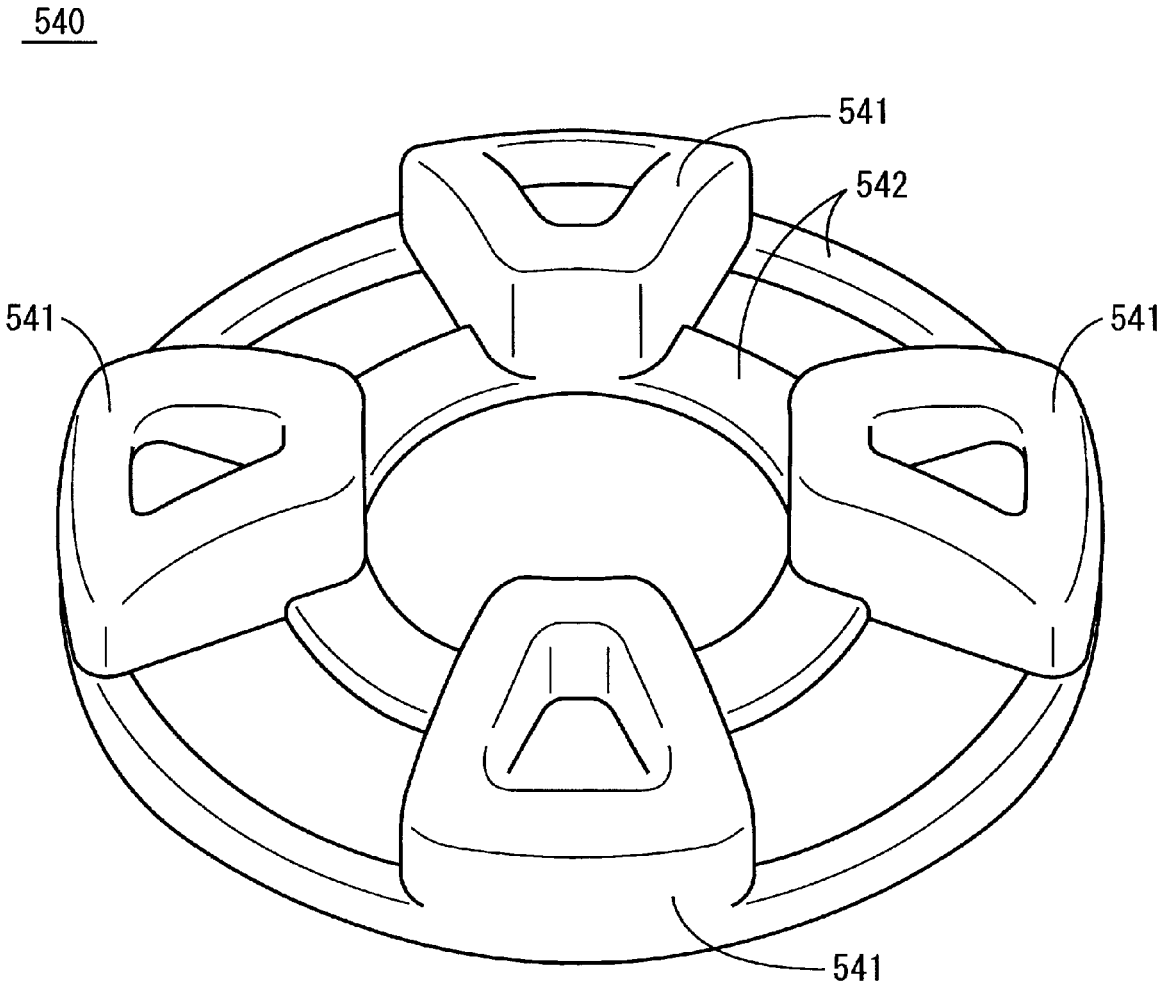
FIG. 7 is a schematic perspective view of a fitting block of the same device.
Figure 8:
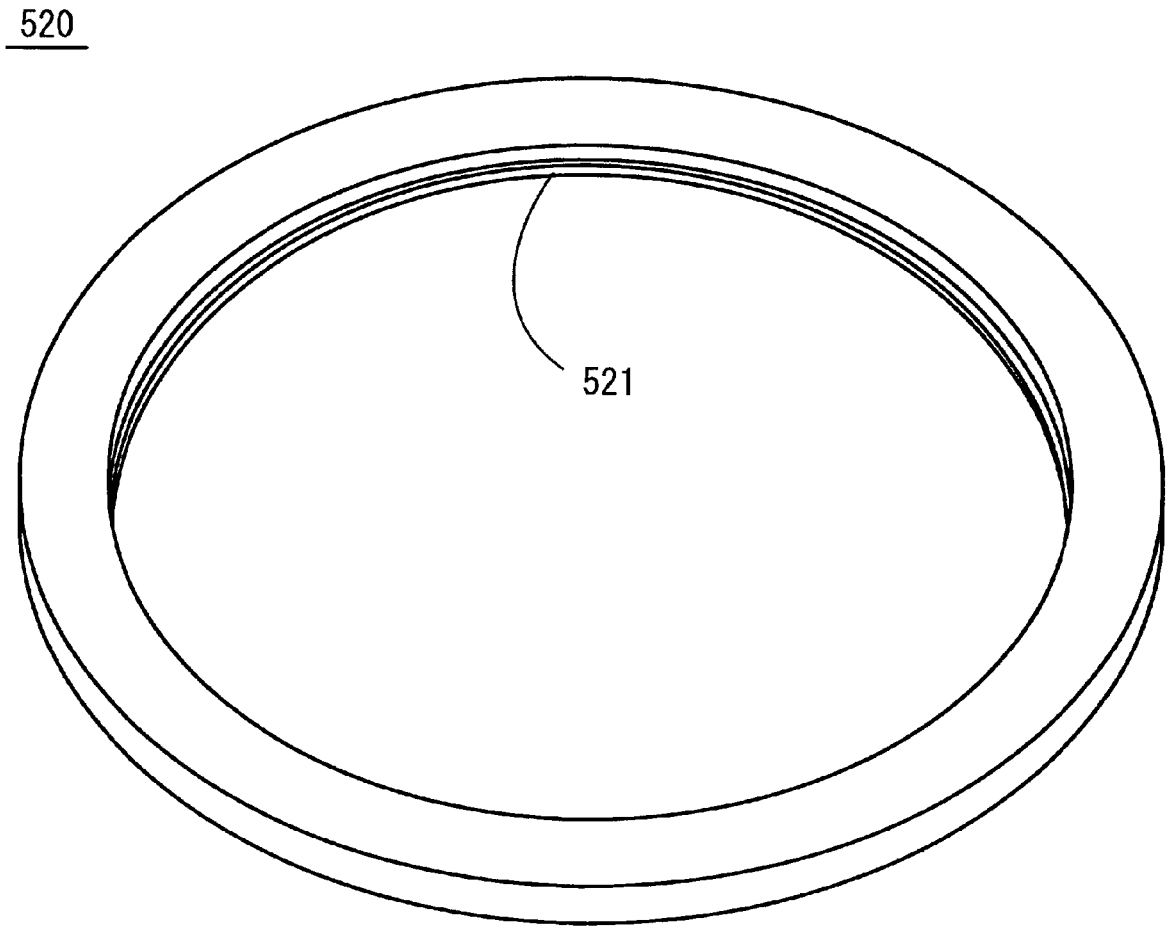
FIG. 8 is a perspective view of a second returning assisting plate of the same device.

A pointing device according to certain exemplary embodiments will be described below with reference to drawings. FIG. 1 is a schematic perspective view of a pointing device according to certain exemplary embodiments; FIG. 2 is a schematic sectional view of the same device; FIG. 3 is a schematic sectional view showing an operation state of the same device; FIG. 4 is a schematic sectional view of an origin returning mechanism of the same device; FIGS. 5A and 5B are views showing an operating body of the same device, FIG. 5A is a schematic front view, and FIG. 5B is a schematic plan view; FIG. 6 is a schematic perspective view of a first returning assisting plate of the same device; FIG. 7 is a schematic perspective view of a fitting block of the same device; FIG. 8 is a perspective view of a second returning assisting plate of the same device; FIGS. 9A and 9B are views showing a built-in board of the same device, FIG. 9A is a schematic plan view, and FIG. 9B is a schematic bottom view; FIGS. 10A, 10B, and 10C are views showing a first moving body of the same device, FIG. 10A is a schematic plan view, FIG. 10B is a schematic front view, and FIG. 10C is a schematic bottom view; and FIGS. 11A, 11B, and 11C are views showing a second moving body of the same device, FIG. 11A is a schematic plan view, FIG. 11B is a schematic front view, and FIG. 11C is a schematic bottom view.

The pointing device shown in FIG. 1 and FIG. 2 includes a case body 100 having an opening 111*a* in a cover portion 111; an operating body 200 in which one end operably protrudes from the opening 111*a* of the case body 100 and is movable depending on the aforementioned operation in a horizontal direction from an origin position α that is a central position of the opening 111*a*; first and second moving bodies 300*a* and 300*b* which are movable in X and Y directions in the case body 100 depending on movement of the operating body 200; first and second signal output units 400*a* and 400*b* which output a signal depending on movement of the first and second moving bodies 300*a* and 300*b*; and an origin returning mechanism 500 provided for returning the operating body 200 to the origin position α. Each of the parts will be described in detail below.

The case body 100 is configured to include an upper case 110 having the cover portion 111, a lower case 120 mounted on the upper case 110, and a pedestal 130 disposed between the upper and lower cases 110 and 120.

As shown in FIG. 2 and FIG. 3, the lower case 120 is a resin molding product having a plate-like bottom plate 121 and four latching claws 122 arranged in a standing condition by four sides on an upper surface (surface facing the pedestal opposite) of the bottom plate 121. A built-in board 600 having an upper surface on which first and second resistance circuits 410*a* and 410*b* of the first and second signal output units 400*a* and 400*b* are formed is mounted on the bottom plate 121 of the lower case 120.

The pedestal 130 is a resin molding product having a substantially plate-like pedestal body 131 and four support legs 132 arranged in a standing condition composed by four sides under a lower surface (surface facing the bottom plate) of the pedestal body 131 and mounted on the four sides on the upper surface of the built-in board 600.

The pedestal body 131 is provided with a hole portion 131*a* penetrating in the thickness direction. The hole portion 131*a* has its center located on the plumb line of the origin position α into which the operating body 200 is penetrated.

On an upper surface (surface facing the cover portion) of the pedestal body 131, there is provided a convex portion 131*b*, which has its center located on the plumb line of the origin position α and is formed in a substantially sphere-like convex shape convexly curved toward the cover portion 111 of the upper case 110. The convex portion 131*b* has a plurality of ring shaped protruding portions 131*b*' and the upper end surfaces of the protruding portions 131*b*' are substantially arranged on a imaginary sphere.

Meanwhile, four convex guide portions 131*c* for the purpose of guiding the first and second moving bodies 300*a* and 300*b* are provided in an internal part of four support legs 132 under the lower surface of the pedestal body 131.

The upper case 110 is a resin molding product which has the plate-like cover portion 111 having the opening 111*a* at a central portion thereof; and side wall portions 112 arranged in a standing condition composed by four sides under a lower surface (surface facing the pedestal) of the cover portion 111 and mounted on the four sides of the pedestal body 131 of the pedestal 130. Latching portions 112*a* in which the latching claws 122 of the lower case 120 are provided on the four side wall portions 112, respectively.

A lower surface of an opening edge 111*b* of the cover portion 111 of the upper case 110, or a surface facing a fitting block of the origin returning mechanism 500, is a tapered surface inclined from an internal side toward an external side.

Figure 5:
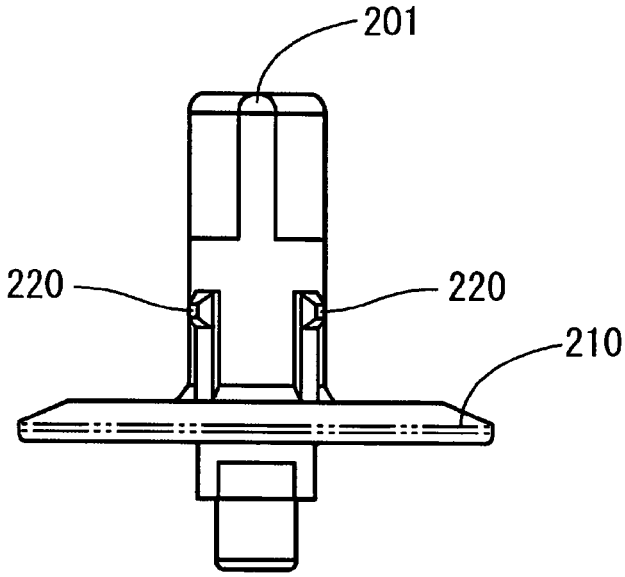
FIGS. 5A and 5B are views showing an operating body of the same device.
Figure 5:
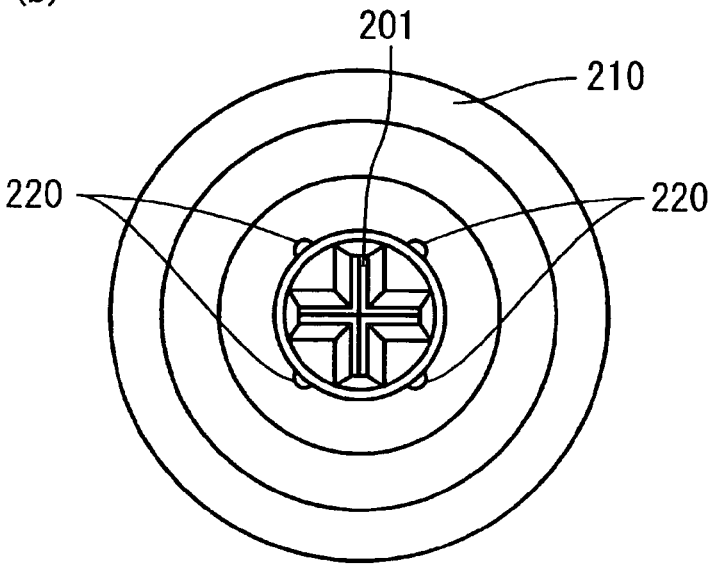

The operating body 200 is a resin molding product in which a rod-like operating body 201 and a disk-shaped plate-like portion 210 are integrally provided at a central portion of the operating body 201, as shown in FIG. 4 and FIG. 5. The plate-like portion 210 is a member mounted on the convex portion 131*b* provided in the pedestal body 131 of the pedestal 130 and a lower surface (surface facing the convex portion) is formed to be a sphere-like concave surface. That is, the plate-like portion 210 slides on the upper end surface of the protruding portions 131*b*' of the convex portion 131*b*, whereby sliding operation can be performed in the horizontal direction while the operating body 200 is maintained at a predetermined leaning angle.

Furthermore, four latching convex portions 220, which are latched in four latching grooves 512*a* of a press-fit portion 512 of a first returning assisting plate 510 of the origin returning mechanism 500, are provided at even spaces on a circumference surface at an upper part of the plate-like portion arrangement position in a central portion of the operating body 201.

One end of the operating body 201 is in a substantially cross-shaped, seen from the top. A disk-shaped operation portion not shown in the drawing is mounted on the one end. Meanwhile, the other end of the operating body 201 is inserted into the hole portion 131*a* of the pedestal body 131 of the pedestal 130 and elongated holes 311*a* and 311*b* of the first and second moving bodies 300*a* and 300*b*.

Figure 10:
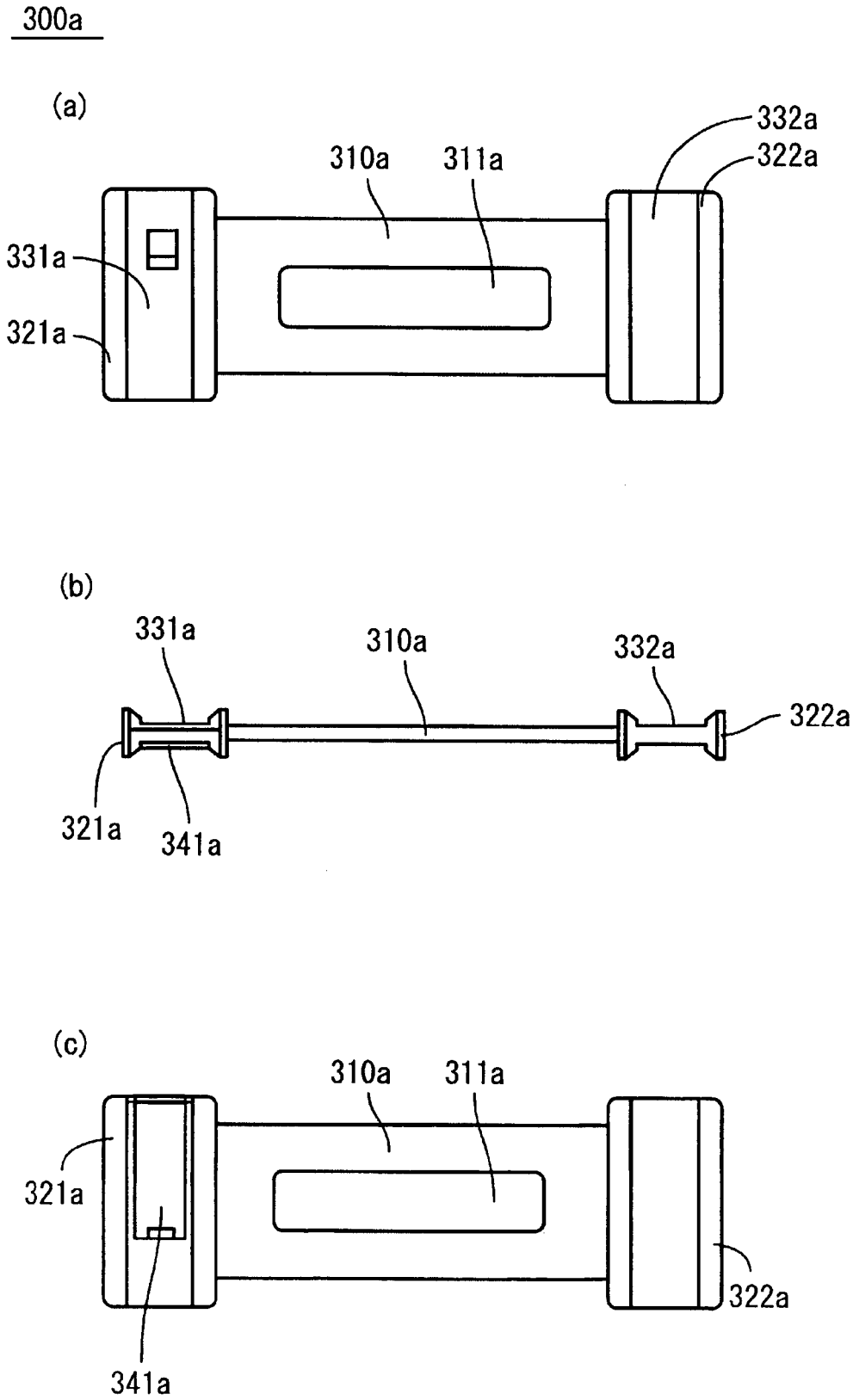
FIGS. 10A, 10B, and 10C are views showing a first moving body of the same device.

The first moving body 300*a* is arranged between the pedestal 130 and the lower case 120 so as to be intersected with each other, as shown in FIG. 2 and FIG. 3. As shown in FIG. 3 and FIG. 10, the first moving body 300*a* includes a plate portion 310*a* extending in a direction perpendicular to the movement direction (X direction) and slider portions 321*a* and 322*a* provided on both sides in the longitudinal direction of the plate portion 310*a*.

A concave groove portion 331*a* slidably fitted into the guide portion 131*c* of the pedestal body 131 of the pedestal 130 is provided on an upper surface of the slider portion 321*a*. Similarly, a concave groove portion 332*a* slidably fitted into the guide portion 131*c* of the pedestal body 131 of the pedestal 130 is provided on an upper surface of the slider portion 322*a*. Furthermore, an accommodation portion 341*a* for accommodating a first contact 420*a* of the first signal output unit 400*a* is provided in the lower surface of the slider portion 321*a*.

The elongated hole 311*a* extending in a direction perpendicular to the X direction is provided in the plate portion 310*a*. The other end of the operating body 200 is inserted into the elongated hole 311*a*. That is, an end surface in the width direction of the elongated hole 311*a* is pressed by the other end of the operating body 200; whereby the groove portions 331*a* and 332*a* of the slider portions 321*a* and 322*a* are guided by the guide portions 131*c* and 131*c* facing with each other, of the pedestal body 131 of the pedestal 130; and therefore, the first moving body 300*a* moves in the X direction along on the surface of the built-in board 600.

Figure 11:
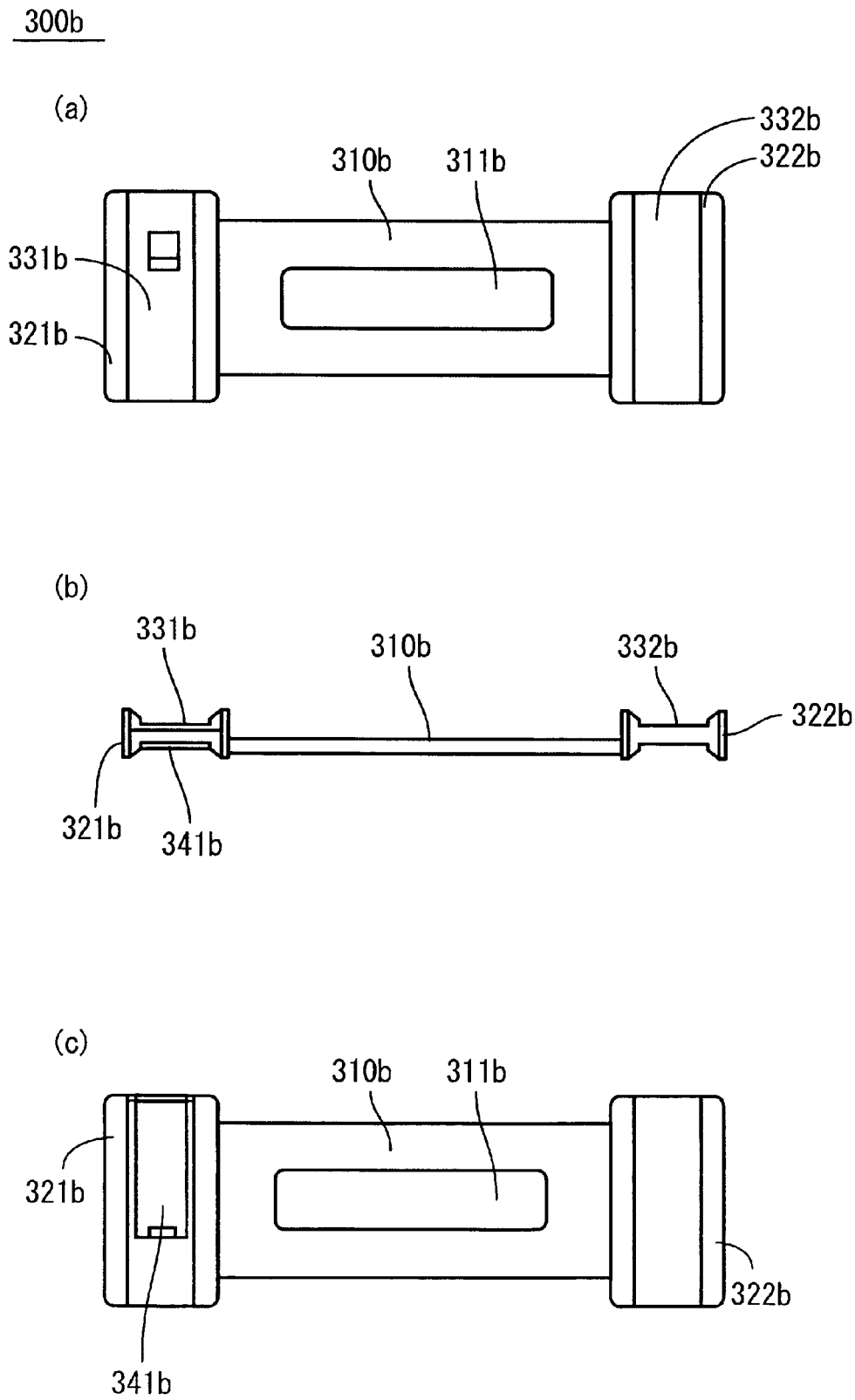
FIGS. 11A, 11B, and 11C are views showing a second moving body of the same device.

As shown in FIG. 2 and FIG. 11, the second moving body 300*b* is almost the same configuration as the first moving body 300*a* except that the plate portion 310*b* of the second moving body 300*b* is disposed at lower ends of the slider portions 321*b* and 322*b* in order that the plate portion 310*b* of the second moving body 300*b* can intersect with the plate portion 310*a* of the first moving body 300*a*. Consequently, the description of overlapping portions will not be repeated.

Figure 9:
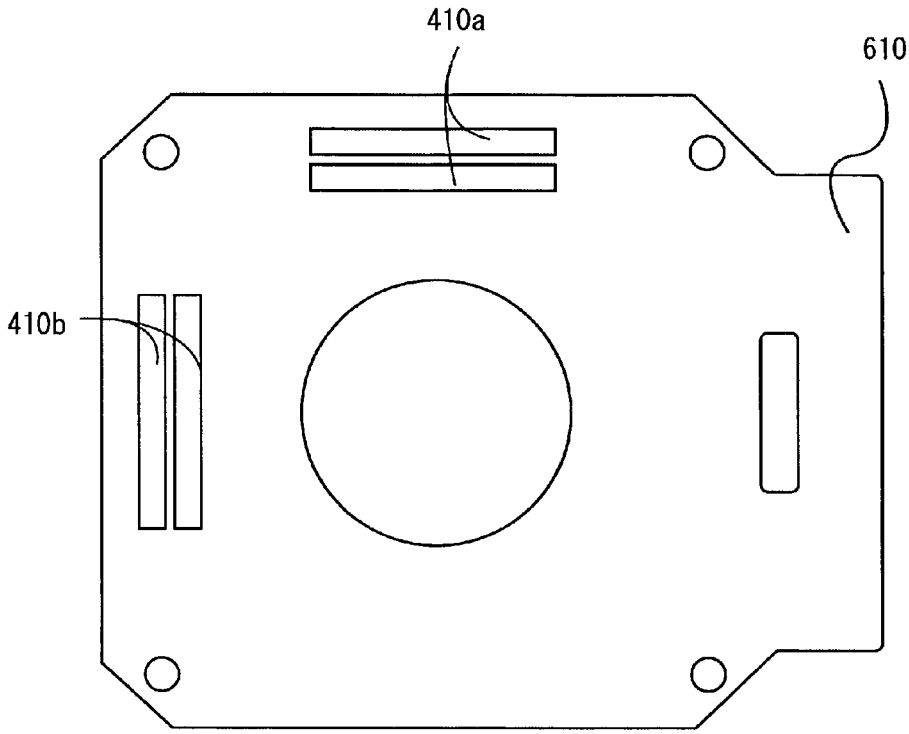
FIGS. 9A and 9B are views showing a built-in board of the same device.
Figure 9:
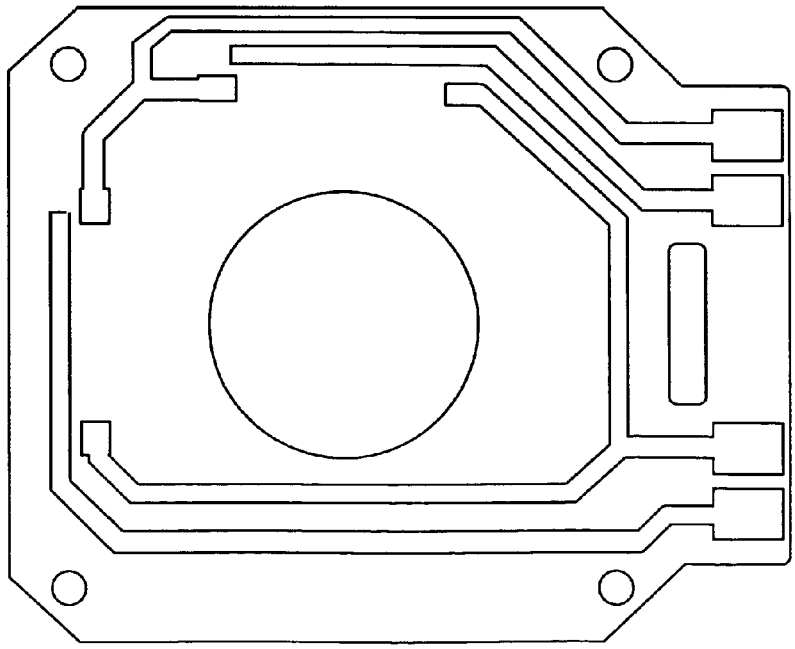

The first and second signal output units 400*a* and 400*b* includes the first and second resistance circuits 410*a* and 410*b* provided on the surface of the built-in board 600 and the first and second contacts 420*a* and 420*b* which come in slidably contact with the first and second resistance circuits 410*a* and 410*b*, as shown in FIG. 2, FIG. 3, and FIG. 9. The first and second contacts 420*a* and 420*b* are accommodated in the accommodation portions 341*a* and 341*b* of the slider portions 321*a* and 321*b* of the first and second moving bodies 300*a* and 300*b* so as to come in slidably contact with the first and second resistance circuits 410*a* and 410*b* by the movement of the associated first and second moving bodies 300*a* and 300*b*. That is, it is such that change in resistance value due to the aforementioned slidable contact is outputted outside as an output signal via the built-in board 600.

As shown in FIG. 3 and FIG. 4, the origin returning mechanism 500 includes the first returning assisting plate 510 mounted at a portion positioned in the case body 100 of the operating body 200 and formed with four reception holes 511; a second returning assisting plate 520 mounted on an upper portion of the outer circumference surface of the first returning assisting plate; a first biasing means 530 which biases the outer circumference surface of the first returning assisting plate 510 and the lower surface of the second returning assisting plate; a fitting block 540 capable of moving in and out of the four reception holes 511 of the first returning assisting plate 510; and a second biasing means 550 which biases the fitting block 540 toward the cover portion 111 of the upper case 110.

The first returning assisting plate 510 is a substantially round member and the four reception holes 511 penetrating in the thickness direction are provided at even spaces, as shown in FIG. 4 and FIG. 6. Furthermore, the press-fit portion 512 in which the operating body 200 is press-fitted is provided at a central portion of the first returning assisting plate 510.

The press-fit portion 512 is a hole into which the operating body 201 of the operating body 200 is press-fitted; and four latching grooves 512*a* in which the four latching convex portions 220 of the operating body 200 are latched are provided in the inner circumferential surface at even spaces. That is, the operating body 201 is press-fitted into the press-fit portion 512 and the latching convex portions 220 are latched in the latching grooves 512*a*, whereby the first returning assisting plate 510 is attached to the operating body 201.

When the first returning assisting plate 510 is accommodated in the case body 100 in a state being attached to the operating body 200, an upper surface (surface facing the cover portion) of the aforementioned first returning assisting plate 510 comes in contact with the cover portion 111 of the upper case 110.

Furthermore, a latching convex portion 513 for the purpose of latching the second returning assisting plate 520 is provided at an upper portion of the outer circumference surface of the first returning assisting plate 510.

As shown in FIG. 4 and FIG. 8, the second returning assisting plate 520 is a ring shaped plate-like body. A latching portion 521 to be latched with the latching convex portion 513 of the first returning assisting plate 510 is provided at a lower portion of the inner circumferential surface of the second returning assisting plate 520. The second returning assisting plate 520 has an upper surface (surface facing the cover portion) which also comes in contact with the cover portion 111 of the upper case 110 in a state being accommodated in the case body 100 together with the operating body 200 and the first returning assisting plate 510.

The first biasing means 530 is for the purpose of retaining the operating body 200 at the origin position $\alpha$ and uses a substantially cone-shaped coil spring in which one end in the longitudinal direction is shrunk in diameter as compared with the other end. As shown in FIG. 2 and FIG. 3, the first biasing means 530 has one end which comes in contact with the outer circumference surface of the first returning assisting plate 510 and the lower surface of the second returning assisting plate; and the other end which is mounted on the circumferential portion of the convex portion 131*b* of the pedestal body 131 of the pedestal 130. That is, the first biasing means 530 is arranged in a compressed state between the circumferential portion of the convex portion 131*b* of the pedestal body 131 of the pedestal 130 and the outer circumference surface of the first returning assisting plate 510 and the lower surface of the second returning assisting plate; and biases the first and second returning assisting plates 510 and 520 toward the cover portion 111 of the upper case 110.

The fitting block 540 has four block bodies 541 accommodated movably in and out of the four reception holes 511 of the first returning assisting plate 510 and connecting portions 542 for circularly connecting the four block bodies 541, as shown in FIG. 2, FIG. 3, FIG. 4, and FIG. 7.

The block body 541 is biased by the second biasing means 550 toward the cover portion 111 of the upper case 110. Therefore, the block body 541 protrudes from the reception hole 511 of the first returning assisting plate to fit into the opening 111*a* of the cover portion 111 of the upper case 110 when the operating body 200 is located at the origin position α; on the contrary, the block body slides on the cover portion 111 of the upper case 110 when the operating body 200 is operated from the origin position α toward the horizontal direction.

An upper surface (surface facing the cover portion) of the block body 541 is a tapered surface inclined from the inner side toward the outer side. Thereby, large force is not required in starting operation of the operating body 200 and the fitting between the block body 541 and the opening 111*a* of the cover portion 111 of the upper case 110 can be easily released.

The second biasing means 550 is for the purpose of biasing the fitting block 540 toward the cover portion for retaining and uses a substantially inverted cone-shaped coil spring whose one end is shrunk in diameter in the longitudinal direction as compared with other end. As shown in FIG. 2 and FIG. 3, the second biasing means 550 has one end which comes into contact with on the surface of the plate-like portion 210 of the operating body 200; and, on the contrary, the other end which comes into contact with the lower surface of the block body 541. That is, the second biasing means 550 is arranged in a compressed state between the block body 541 and the plate-like portion 210 of the operating body 200 to bias the fitting block 540 toward the cover portion 111 of the upper case 110.

As for the built-in board 600, a printed board is used, as shown in FIG. 9. A protruding portion 610 which protrudes outside the case body 100 is provided in the built-in board 600. The protruding portion 610 is used as external connection.

A method of using such the pointing device will be described below and operation of each part will be described. First, the operating body 200 located at the origin position α is movement-operated in the X direction against biasing force of the first biasing means 530.

Then, the fitting block 540 goes down in the case body 100 against biasing force of the second biasing means 550. Thereby, the fitting between the fitting block 540 and the opening 111*b* of the cover portion 111 of the upper case 110 is released and the operating body 200 becomes movable to move toward the X direction.

At this time, the plate-like portion 210 of the operating body 200 slides on the surface of the convex portion 131*b* of the pedestal body 131 of the pedestal 130. The first and second returning assisting plates 510 and 520 and the four block bodies 541 of the fitting block 540 slide on the lower surface of the cover portion 111 of the upper case 110. With this, the first moving body 300*a* moves in the X direction and the first contact 420*a* slides on a first resistance circuit 410*a*. Thereby, a resistance value varied depending on an amount of movement of the first moving body 300*a* is outputted as an output signal of the first signal output unit 400*a*. By this output signal, the movement and the amount of the movement toward the X direction of the operating body 200 are inputted to electronic equipment in which the aforementioned pointing device is used.

After that, when the operating body 200 is released, the operating body 200 moves toward the origin position α due to the biasing force of the first biasing means 530. Then, when the operating body 200 comes close in the vicinity of the origin position α and the four block bodies 541 of the fitting block 540 slide on the lower surface of the opening edge 111*b* of the cover portion 111 of the upper case 110, force moving toward the origin position α is added by the biasing force of the second biasing means 550. Thereby, returning force, due to the biasing force of the first biasing means 530 which weakens when the operating body 200 is located in the vicinity of the origin position α, can be strengthened again.

When the operating body 200 is located at the origin position α, the four block bodies 541 of the fitting block 540 are fitted into the opening 111*a* of the cover portion 111 of the upper case 110. Thereby, the operating body 200 stops at the origin position α.

In the case where the operating body 200 located at the origin position α is movement-operated in the Y direction, the second moving body 300*b* moves in the Y direction and the second contact 420*b* slides on the first resistance circuit 410*b*. Thereby, except that the resistance value varied depending on an amount of movement of the second moving body 300*b* is outputted as an output signal of the second signal output unit 400*b*, each part operates as in the case of the movement in the X direction. Consequently, the movement and the amount of movement toward the Y direction of the operating body 200 are inputted by the abovementioned output signal to electronic equipment in which the aforementioned pointing device is used.

In the case where the operating body 200 located at the origin position α is movement-operated in a horizontal direction combined by X and Y, the first and second moving bodies 300*a* and 300*b* respectively move as described above; and an output signal is outputted from the first and second signal output units 400*a* and 400*b* respectively. The movement direction and the amount of the movement of the operating body 200 are inputted by combination of such output signals to electronic equipment in which the aforementioned pointing device is used.

In the case of such a pointing device, it is such that the outer circumference surface of the first returning assisting plate 510 and the lower surface of the second returning assisting plate 520 are biased by the first biasing means 530 to retain the operating body 200 at the origin position α. That is, it is such that the operating body 200 is returned to the origin position α by only the biasing force of the first biasing means 530 and therefore returning operation of the operating body 200 can be highly accurately performed, not suffering from spring force variation caused by a plurality of coil springs as in the conventional example. Furthermore, when the operating body 200 is located at the origin position α, the four block bodies 541 of the fitting block 540 are biased by the second biasing means 550, thereby protruding from the four reception holes 511 of the first returning assisting plate so as to fit into the opening 111*a* of the cover portion 111 of the upper case 110, whereby the operating body 200 can be stopped at the origin position α. Therefore, the operating body 200 undergoing the biasing force of the first biasing means 530 does not move beyond the origin position by inertia force of the returning movement. Consequently, in this regard also, the returning operation of the operating body 200 can be highly accurately performed. Further, it is such that the biasing force of the second biasing means 550 also contributes as the returning force of the operating body 200 when the operating body 200 is located in the vicinity of the origin positions. Therefore, the returning force due to the biasing force of the first biasing means 530 which becomes small in the vicinity of the origin position α can be strengthened again and therefore the operating body 200 can be rapidly returned to the origin position α.

As for the origin returning mechanism of the pointing device, any design change may be performed as far as it is such that in a pointing device having an operating body in which one end operably protrudes from an opening of a cover portion of a case body and which is movable depending on the operation toward a horizontal direction from an origin position that is a central position of the opening, the origin returning mechanism includes a first returning assisting plate arranged at a portion of the operating body located inside the case, with the plate having a reception hole penetrating in the thickness direction; a first biasing means for retaining the operating body at the origin position by biasing an outer circumference surface of the first returning assisting plate; a fitting block accommodated movably in and out of the reception hole of the first returning assisting plate; and a second biasing means for biasing the fitting block toward the cover portion of the case body, wherein the fitting block protrudes from the reception hole of the first returning assisting plate to fit into the opening of the case body by being biased with the second biasing means when the operating body is located at the origin position.

That is, the case body 100, the operating body 200, the first and second moving bodies 300*a* and 300*b*, and the first and second signal output units 400*a* and 400*b* are not limited to the above-mentioned embodiment. More specifically, they may be as follows.

As for the case body 110, it includes the upper case 110, the lower case 120, and the pedestal 130; however, any shaped element may be used as far as it is a housing having the opening 111*a* in the cover portion 111.

The operating body 200 may use any shape as far as it is a rod-like body. Consequently, the plate-like portion 210 may be attached to the operating body 200 as a separated body. Furthermore, the plate-like portion 210 may use any shape as far as it is a plate-like body.

The first and second signal output units 400*a* and 400*b* may use any shaped element as far as it can output a signal depending on the movement of the operating body 200. For example, it may be such that a metal plate is attached to the other end of the operating body 200; a magnet is provided on the plumb line of the origin position α of the bottom surface of the case; a plurality of electromagnetic conversion elements are provided on a circumferential portion of the magnet; and change in magnetic field due to passing of the metal plate is converted to a signal by the electromagnetic conversion element to detect the movement of the operating body on the basis of the signal. In this case, the first and second moving bodies 300*a* and 300*b* are not required.

The first returning assisting plate 510 includes four reception holes 511; however, at least one reception hole may be provided. For example, the reception hole may be a ring shaped hole and the ring shaped fitting block can be accommodated movably in and out of the aforementioned reception hole. Furthermore, the first returning assisting plate 510 can be also integrally provided with the operating body 200. In this case, it is required that the plate-like portion 210 is a separate body and the second biasing means 550 can be arranged between the plate-like portion 210 and the fitting block 540.

It is optional whether or not the second returning assisting plate 520 is provided. Furthermore, the second returning assisting plate 520 may be integrally provided with the first returning assisting plate 510.

The fitting block 540 can be set its shape optionally depending on the shape of the reception hole of the first returning assisting plate. Furthermore, although it is previously recited that the fitting block 540 has four block bodies 541 connected by connecting portions 542, the four block bodies 541 can be separated.

At least one of an upper surface of the fitting block 540 and the lower surface of the opening edge 111*b* of the cover portion 111 is desirable to be a tapered surface; however, it is also acceptably possible to have neither of the surfaces not to be a tapered surface.

The first biasing means 530 is a cone-shaped coil spring; however, any shaped element can be used as far as it can bias the first returning assisting plate 510 to the origin position α. For example, it is also acceptably possible to use a pyramid-shaped coil spring or the like. In this case, the plate-like portion 210 of the operating body 200 is a rectangular plate-like body. This may be applied to the second biasing means 550.

What is claimed is:

1. An origin returning mechanism of a pointing device having an operating body in which one end operably protrudes from an opening of a cover portion of a case body and which is movable depending on the operation toward a horizontal direction from an origin position that is a central position of the opening, the origin returning mechanism comprising:

a first returning assisting plate arranged at a portion of the operating body located inside the case body, the plate being movable together with the operating body and having a reception hole penetrating in the thickness direction;

a first biasing element for retaining the operating body at the origin position by biasing an outer circumference surface of the first returning assisting plate;

a fitting block accommodated movably in and out of the reception hole of the first returning assisting plate; and a second biasing element for biasing the fitting block toward the cover portion of the case body, wherein the fitting block protrudes from the reception hole of the first returning assisting plate to fit into the opening of the case body by being biased with the second biasing element when the operating body is located at the origin position.

2. The origin returning mechanism of the pointing device according to claim 1, wherein a surface of the fitting block facing the cover portion and/or a surface of an opening edge of the cover portion of the case body facing the fitting block are/is tapered.

3. The origin returning mechanism of the pointing device according to claim 1, wherein the opening of the cover portion of the case body is substantially round, and wherein the first returning assisting plate is a substantially round-shaped plate-like body; and the first biasing element is a coil spring in which one end in a longitudinal direction is shrunk in diameter as compared with the other end, the one end coming into contact with the outer circumference surface of the first returning assisting plate.

4. The origin returning mechanism of the pointing device according to claim 1, wherein the operating body is provided with a plate-like portion under the arrangement position of the first returning assisting plate; and the second biasing element is a coil spring in which one end in a longitudinal direction is shrunk in diameter as compared with the other end and is arranged between the fitting block and the plate-like portion in a compressed state.

5. The origin returning mechanism of the pointing device according to claim 3, wherein the second returning assisting plate formed in a ring shape is provided at an upper portion of the outer circumference surface of the first returning assisting plate; and said one end of the first biasing element comes into contact with a lower portion of the outer circumference surface of the first returning assisting plate and a lower surface of the second returning assisting plate.

6. A pointing device comprising:

an operating body in which one end operably protrudes from an opening of a cover portion of a case body and which is movable depending on the operation toward a horizontal direction from an origin position that is a central position of the opening;

first and second moving bodies movable depending on the movement of the operating body in X and Y directions in the case body; and first and second signal output units which output a signal depending on the movement of the first and second moving bodies, the pointing device comprising:

the origin returning mechanism of a pointing device as set forth in claim 1, which returns the operating body to the origin position.

7. The pointing device according to claim 6, wherein the operating body is provided with the plate-like portion, and wherein the case body includes an upper case having the cover portion, a lower case mounted on the upper case, and a pedestal arranged between the upper and lower cases, the pedestal having a surface facing the cover portion of the upper case being provided with a substantially sphere-like convex portion in which a center is located on the plumb line of the origin position and which is convexly curved toward the cover portion of the upper case; and the plate-like portion having a sphere-like concave surface facing the convex portion and being slidable on the convex portion with the movement of the operating body.

8. The pointing device according to claim 7, wherein a space between the pedestal and the lower case accommodates a built-in board disposed on a bottom plate of the lower case and the first and second moving bodies movable in the X and Y directions along on a surface of the built-in board;

the pedestal is provided with a hole portion in which a center is located on the plumb line of the origin position;

the first and second moving bodies are provided with first and second elongated holes extending in the Y and X directions; and the other end of the operating body passes through the hole portion of the pedestal to be inserted into the elongated holes provided in the first and second moving bodies.

9. The pointing device according to claim 8, the first and second signal output units comprising:

first and second resistance circuits provided on the surface of the built-in board; and first and second contacts attached at longitudinal ends of the first and second moving bodies and slidably contactable with the first and second resistance circuits.

* * * * *